United States Patent [19]

Horton et al.

[11] Patent Number: 4,558,653

[45] Date of Patent: Dec. 17, 1985

[54] LABEL ADVANCING SYSTEM FOR A LINE CLOSER MACHINE

[75] Inventors: Gilbert L. Horton, Kernersville; Eddie D. Poole, Lexington; John W. Foreman, Jr., Elkin; all of N.C.

[73] Assignee: Sara Lee Corporation, Winston-Salem, N.C.

[21] Appl. No.: 691,281

[22] Filed: Jan. 14, 1985

[51] Int. Cl.[4] ..... D05B 21/00; D05B 97/00

[52] U.S. Cl. ..... 112/262.2; 112/104; 112/113; 112/121.15; 493/375; 493/961

[58] Field of Search ..... 112/121.15, 104, 121.11, 112/121.12, 113; 493/375, 961

[56] References Cited

U.S. PATENT DOCUMENTS

| | | | |
|---|---|---|---|
| 2,997,862 | 4/1961 | DiMaggio et al. | 112/104 X |
| 3,377,972 | 4/1968 | Cohen et al. | 112/104 |
| 3,690,276 | 9/1972 | King et al. | 112/104 X |
| 3,699,907 | 10/1972 | Anderson et al. | 112/104 X |
| 3,766,870 | 10/1973 | Weigert | 112/104 |
| 3,792,672 | 2/1974 | Friedman et al. | 112/104 |
| 3,861,338 | 1/1975 | Galya et al. | 112/104 |
| 3,921,549 | 11/1975 | Goodson | 112/104 |
| 4,030,429 | 6/1977 | Boser et al. | 112/104 |
| 4,267,785 | 5/1981 | Osho | 112/121.15 X |
| 4,389,957 | 6/1983 | Block et al. | 112/104 X |

*Primary Examiner*—H. Hampton Hunter

*Attorney, Agent, or Firm*—Charles Y. Lackey; William S. Burden

[57] ABSTRACT

A system for automatically handling a label and presenting the label to a hosiery blank mounted upon a line closer machine. A label length is advanced from a label strip supply roll; the projecting label length is clamped by a presentator assembly and then is severed from the remainder of the label strip. The presentator assembly is displaced to position the label at a prescribed location within the confines of a hosiery blank mounted upon the line closer machine. The presentator assembly is displaced to move the label within a hosiery blank past sewing instrumentalities to sew the label to a pair of hosiery blanks as the blanks are seamed together.

16 Claims, 16 Drawing Figures

LABEL ADVANCING SYSTEM FOR A LINE CLOSER MACHINE

BRIEF SUMMARY AND OBJECTS OF THE INVENTION

In the hosiery industry, it is customary during the fabrication of a garment to affix a label thereto to indicate garment brand, size, color, etc.

The present invention relates to improvements in a system for handling labels and presenting them to a conventional line closing machine where the labels are sewn into panty hose garments as the U-shaped seams are formed in the garments.

The label advancing or feeder/presentator system is used in conjunction with a line closer in which the latter makes the panty portion of the panty hose garment in the usual manner from the welt portions of a pair of hosiery tubes or blanks having welt, leg and foot portions. The two blanks are sewn together and slit to define a U-shaped seam in the panty portion of the garment.

In the present invention a label supply strip is intermittently advanced from a supply spool, the labels are severed one after another from the supply strip by a cutter mechanism, and individual labels are selectively positioned by a presentator assembly for subsequent attachment adjacent the garment waist band portions by the sewing instrumentalities of the line closer as the U-shaped seam is formed.

One of the primary objects of the invention is the provision of a new and improved system which carries out the repeated intermittent feeding and presenting of labels automatically and reliably into position for seaming the panty hose garment.

Another object of the invention is the provision of a label advancing system wherein labels are sewn into garments without the aid of an operator.

Still another object of the invention is the provision of an assembly for clamping labels and moving the labels into association with sewing instrumentalities forming the U-shaped seam of a panty hose garment.

Another object of the invention is the positioning of a label internal to the construction of the garment allowing the label to be sewn within the seam.

Another object of the invention is the presentation of a single-ply label severed by a pinking action offering nonravelling, thereby eliminating the need for a folded label.

A further object of the invention is to provide an apparatus which is simple in design, rugged in construction and economical in cost.

These and other objects of the invention will become more apparent after a consideration of the following detailed description taken in conjunction with the accompanying drawings wherein like characters of reference designate like parts throughout the several views.

DETAILED DESCRIPTION OF THE INVENTION

Figure 1:
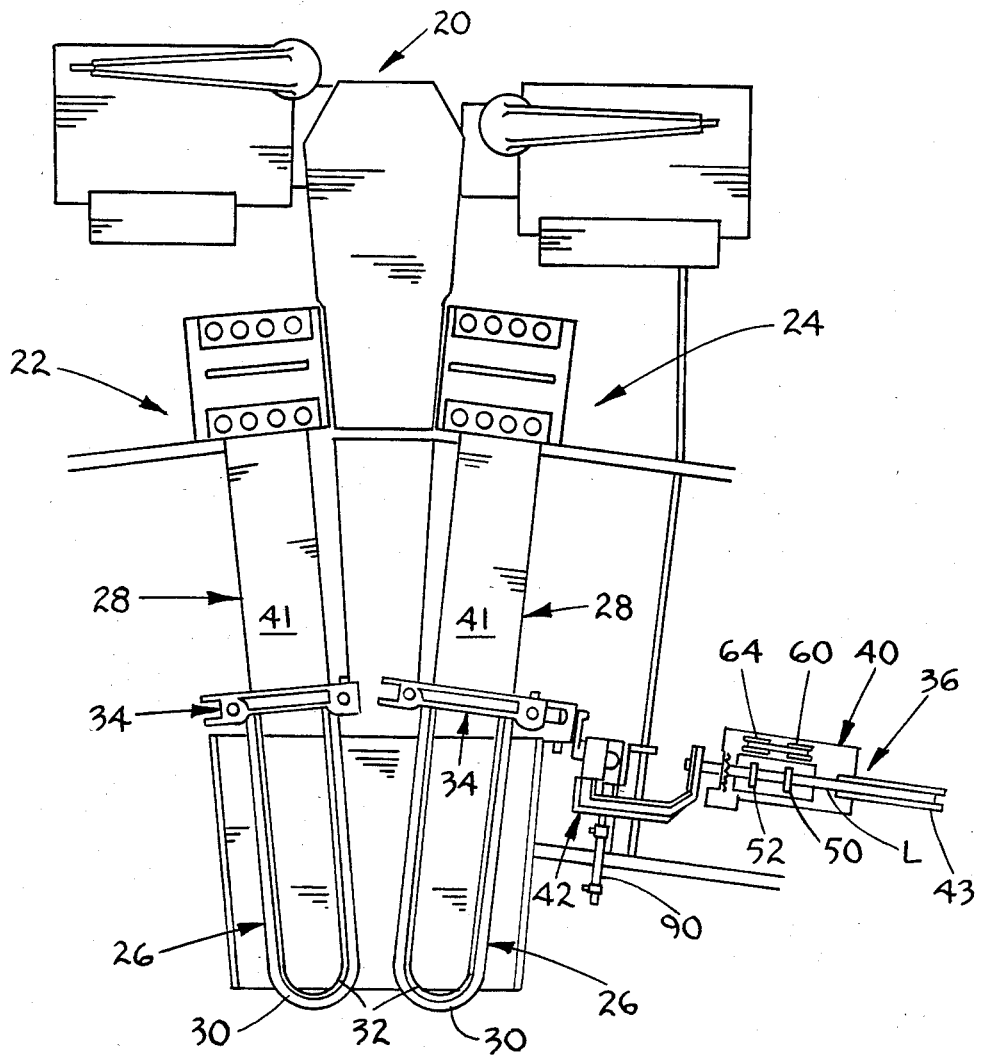
FIG. 1 is a schematic, fragmentary, top plan view of the label feeder/presentator associated with a line closer.

Referring to the drawing, numeral 20 refers to a conventional line closer of the type manufactured by Savio & C. of Milan, Italy. The machine consists of two angularly disposed units 22 and 24, each having a hosiery blank supporting assembly 26 and a sewing machine 28.

Figure 3:
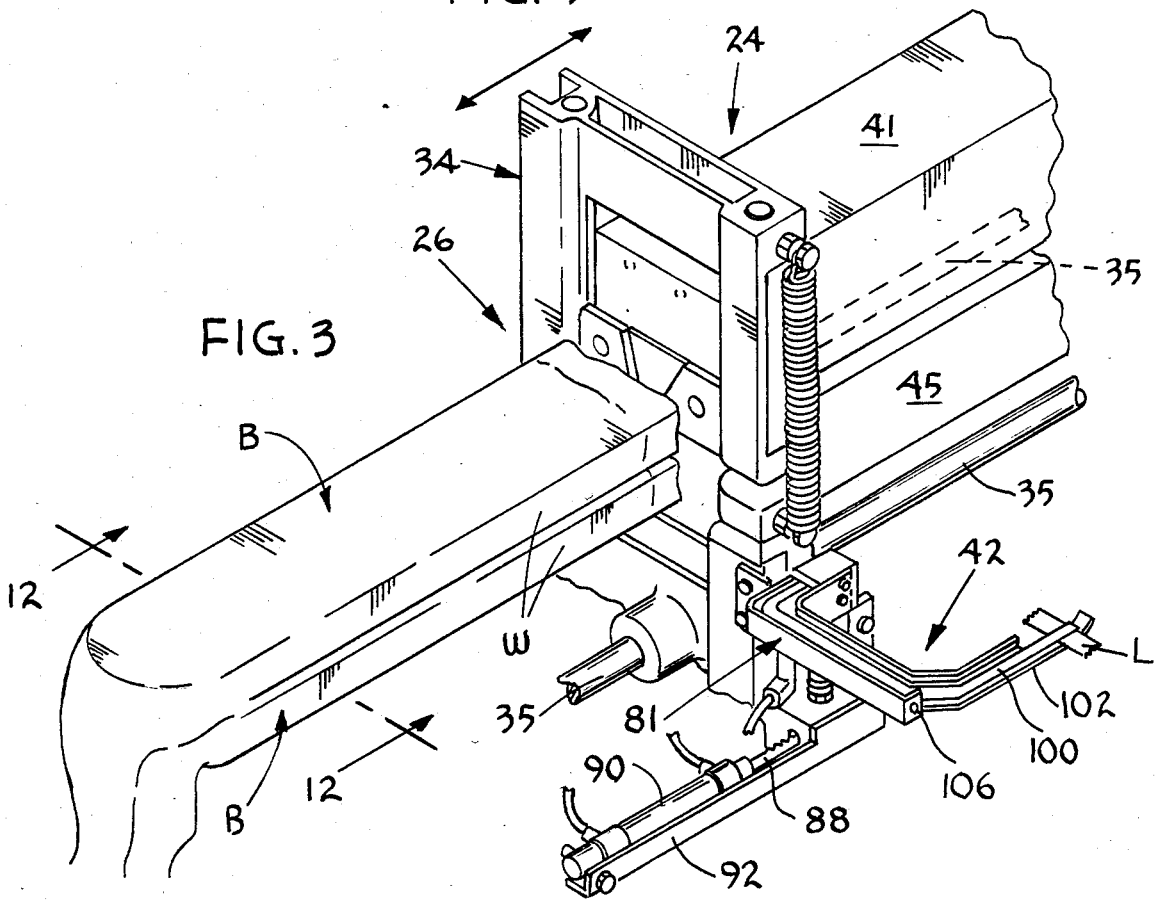
FIG. 3 is an enlarged, fragmentary, perspective view of the line closer and the label presentator assembly in the label receiving position.
Figure 12:
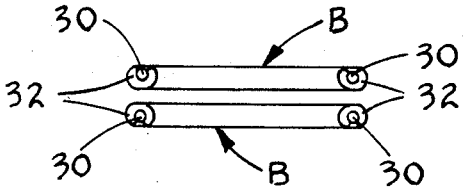
FIG. 12 is a sectional view of the hosiery blanks supporting members taken along line 12—12 of FIG. 3.
Figure 13:
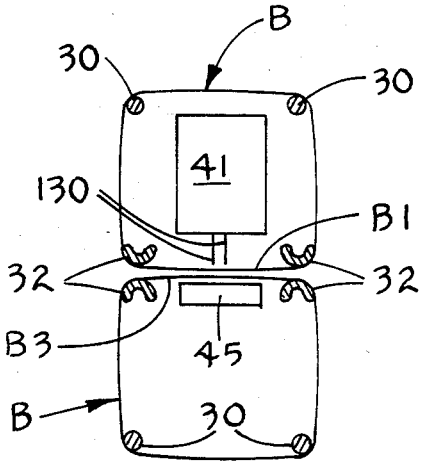
FIG. 13 is a view of the hosiery blank supporting members taken along line 13—13 of FIG. 4.
Figure 9:
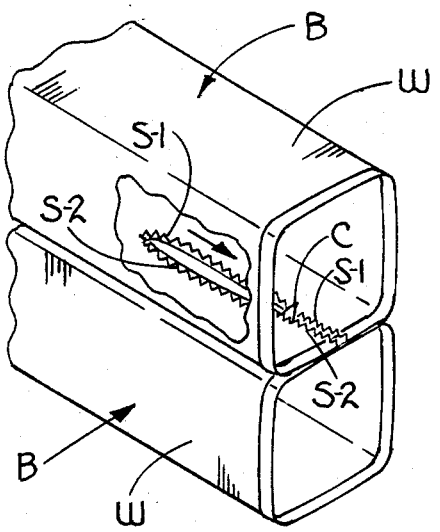
FIG. 9 is a fragmentary, perspective view of hosiery blanks in opened, superposed positions illustrating the two seams, the label sewn to one blank and the cutter for severing the fabric between the seams.
Figure 10:
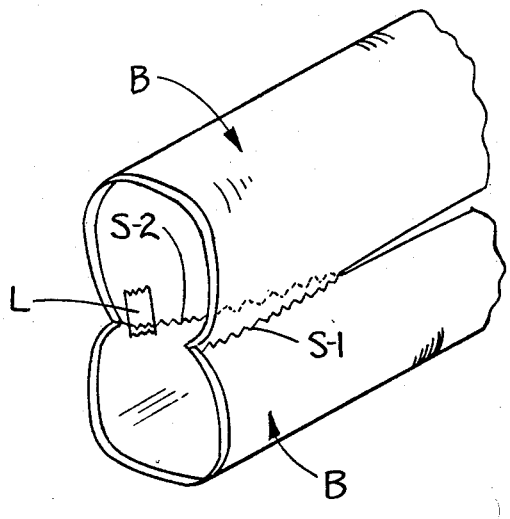
FIG. 10 is a fragmentary, perspective view of the panty hose garment after removal from the line closer.
Figure 11:
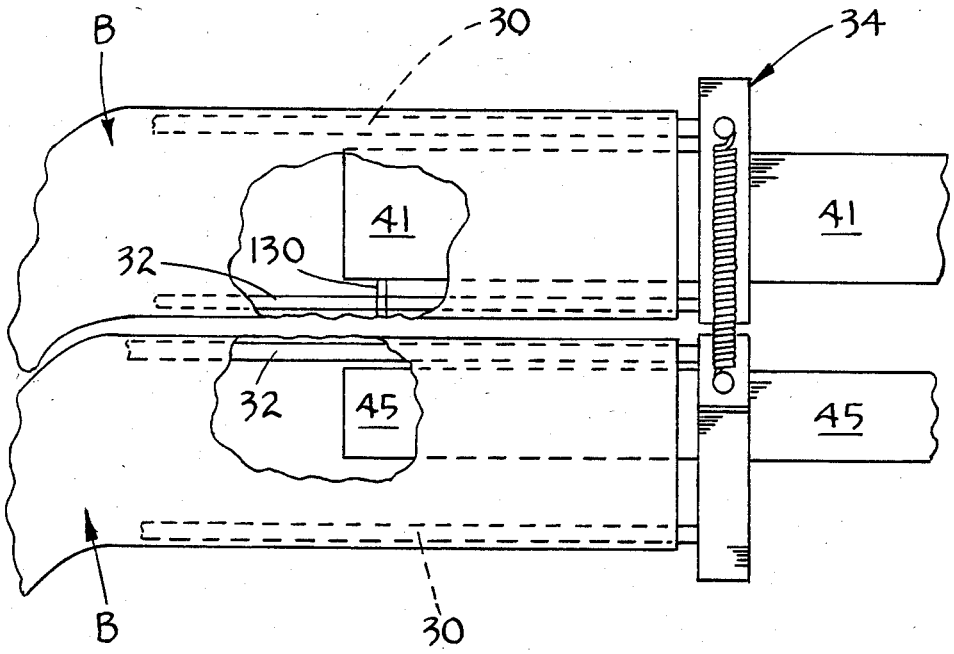
FIG. 11 is an enlarged elevational view of the hosiery blanks and the instrumentalities for sewing the blanks together.

In the operation of unit 24 of the conventional Savio & C. line closer, tubular hosiery blanks B, B are placed on superposed first and second generally U-shaped pairs of blank supporting arm members 30, 32 which in the blank loading positions are in a generally nested relation, as shown by FIG. 12. An operator properly positions the blanks on the arm members 30, 32 with the welt portions W, W aligned, as shown by FIG. 3. Then, in a conventional operation of the machine, the operator actuates a switch 23 and the members 30 are displaced vertically by a fluid cylinder arrangement 33 to expand and open the blanks B, B as shown by FIG. 13. The carriage assembly 34, which carries the arm members 30, 32 and blanks B, B, is advanced along slide rails 35 in a conventional manner by a fluid cylinder 25 such that the upper portion 41 of the sewing machine 28 is received within upper blank B, FIG. 13, and the lower portion of the sewing machine is received within the lower hosiery blank B. With the machine 28 selectively postioned within the blanks B, B and with respect to the carriage assembly 34, depending upon garment size and style to be produced, the sewing instrumentalities 130 are actuated to initiate sewing together adjacent portions B1 and B3 of the blanks. Upon initiating of the sewing instrumentalities, in which will ultimately be the crotch of the garment, the carriage assembly 34 and blanks are displaced relative to the sewing machine 28 by fluid cylinder 25 to define two closely spaced, generally parallel seams S-1, S-2 extending from the garment crotch portion to the waist band. The seams S-1, S-2 are spaced just enough to receive the blade of a cutter mechanism C therebetween. Immediately after the instrumentalities 130 are actuated to start formation of the seams, the cutter mechanism is actuated to punch through and sever the fabric between the two seams. In the crotch portion of the garment where the seams S-1, S-2 are initiated, the seams may be connected or may be in overlapping relation for a short distance. After the blanks B, B have been seamed in the direction of the arrow, FIG. 9, to the end of the blanks, closely followed by the cutter C which severs the blank fabric between the seams, the sewn blanks are removed from the supporting arm members 30, 32 resulting in a panty hose garment having a U-shaped seam, the panty portion of which is shown by FIG. 10.

As shown by the drawings, a label advancing assembly 36 is positioned in close proximity to the unit 24. The two units 22 and 24, although mounted upon a common base, operate independently of one another. While only one assembly 36 has been shown on the drawing and will be described, it is to be understood that a separate label advancing assembly 36 would be provided for the unit 22. The assembly for the unit 22 would be substantially a mirror image of the assembly for unit 24.

Referring to FIGS. 2–6, the label advancing assembly 36 includes a feeder assembly 40 and a presentator assembly 42 positioned in close proximity to unit 24. Labels L to be fed to the sewing head 41 of the machine 28 are wound in strip form on a supply spool 43 which is rotatably supported upon a spool shaft 44 supported by a bracket 46 mounted upon a support 48.

Figure 7:
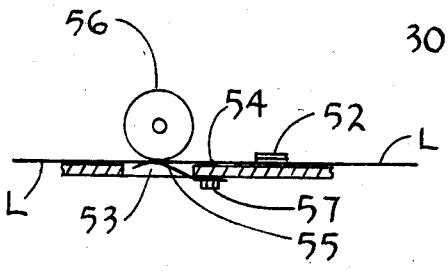
FIG. 7 is an enlarged side elevational view, partly in section, of the mechanism for urging the label strip into engagement with the drive roll.
Figure 6:
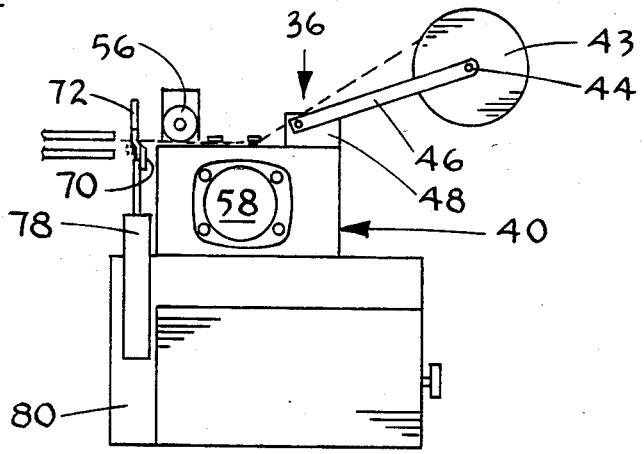
FIG. 6 is a schematic elevational view of the label feeding assembly.
Figure 2:
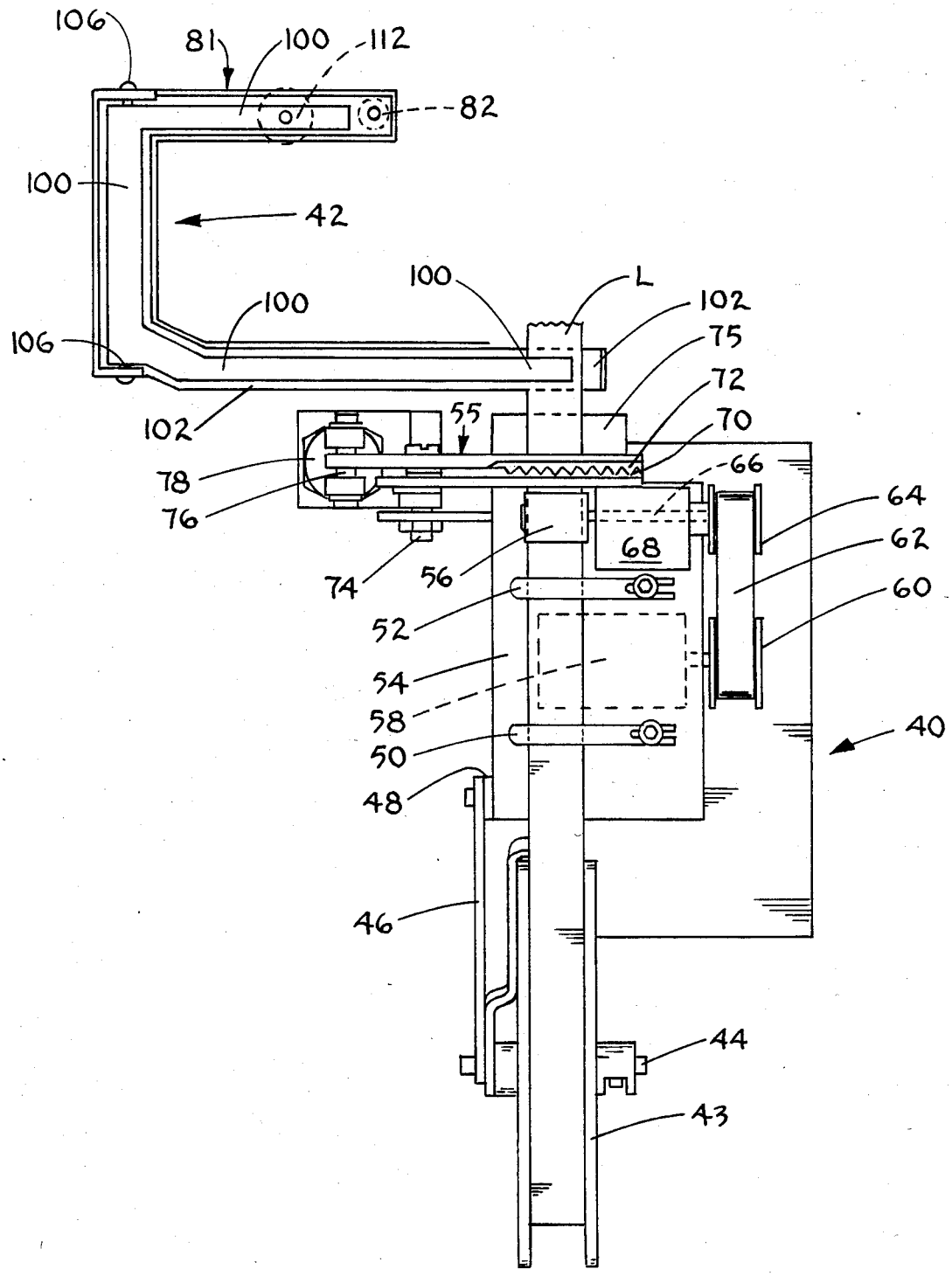
FIG. 2 is an enlarged schematic, fragmentary top plan view of the label feeder/presentator of the present invention.

As shown by FIGS. 6 and 7, the label strip is directed from spool 42 and along the flat smooth surface 54 and beneath spaced guides 50, 52. An opening 53 is provided through the surface 54 directly beneath the drive roll 56 and a leaf spring 55 projects through the opening. As the label strip passes between the leaf spring 55 and the drive roll 56, the spring, which is secured to member 54 by a fastener 57, urges the label strip against roll 56. The strip is advanced through rotation of the roll when motor 58 is activated. The motor is selectively controlled by a timer mechanism T. The motor shaft has a timing pulley 60 secured thereto which is coupled by timing belt 62 to timing pulley 64. The pulley 64 and feed roll 56 are secured for rotation with a shaft 66 mounted in a bearing block 68. The feed roll 56 is such to provide sufficient engagement and traction necessary to advance the label strip. Intermittent activation of the motor 58 for a preselected period of time advances a length of strip corresponding to the length of one label which subsequently is severed from the strip. The motor 58 is controlled to selectively vary the length the strip advanced, depending upon the size of the labels printed on the label strip.

Forward of the feed roll 56 is a cutting assembly 55 including a fixed blade 70 and a movable blade 72. The blade 72 is pivotably mounted upon a pin 74, and an end portion is pivotably secured to a fluid cylinder 78 by a clevis pin 76. The cylinder 78 is mounted upon a support means 80. The cutting blades have alternately angled cutting surfaces designed to provide a pinking shear action, thus affording nonraveling characteristics for the labels L. Cutting of the labels in this manner also eliminates the need for folded labels.

In the operation of the feeder assembly 40, the motor 58 is activated for a predetermined period to drive the feed roll 56 and advance a length of label strip over the fixed blade 70 and beneath the normally raised movable blade 72 and onto a support plate 75. After a predetermined length of strip has been advanced, corresponding to the size or length of one label, the motor is deactivated and the fluid cylinder actuated to pivot the blade 72 to sever a label L from the label strip.

The presentator assembly 42 is secured to and mounted for reciprocable movement with the carriage assembly 34. The assembly is adapted to support a label severed from the label strip and present the label to a seaming position inside the confines of a panty hose blank B held in expanded condition upon supporting arm members 30, 32.

Figure 5:
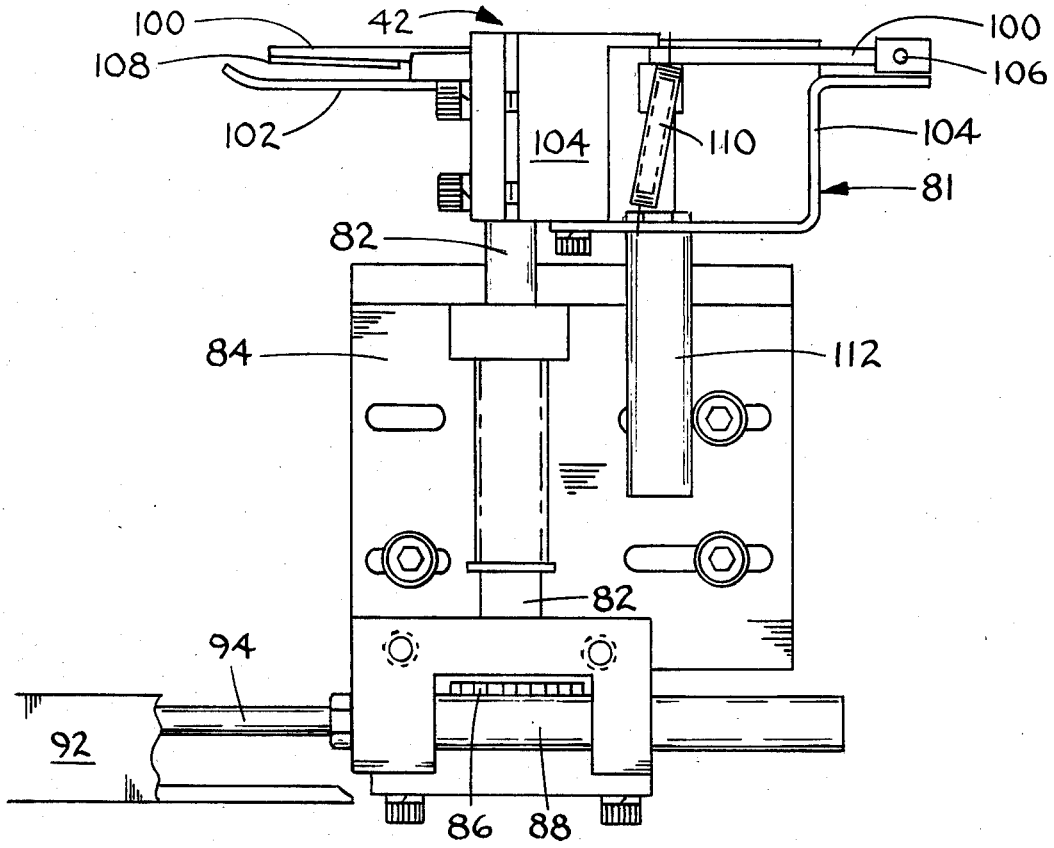
FIG. 5 is an enlarged, fragmentary, schematic, elevational view of the presentator assembly.
Figure 4:
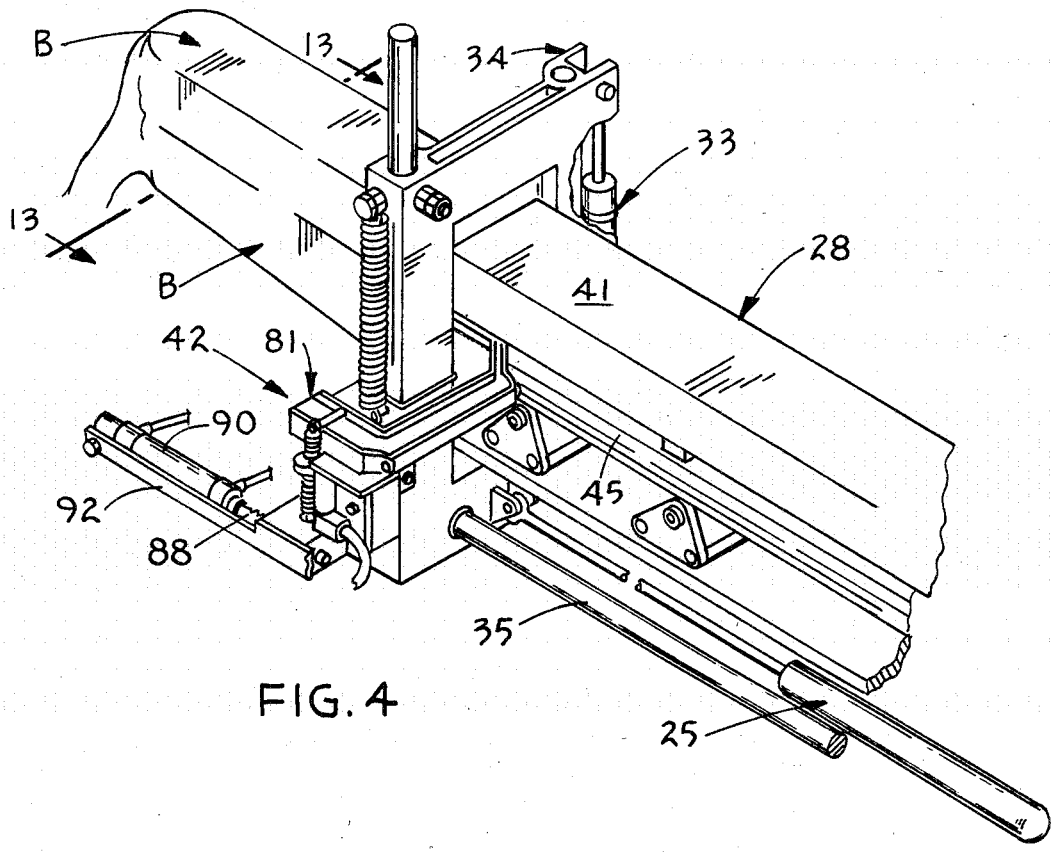
FIG. 4 is an enlarged, fragmentary, perspective view of the line closer and the presentator assembly in position for presentating a label to the sewing instrumentalities.
Figures 8A, 8B, 8C:
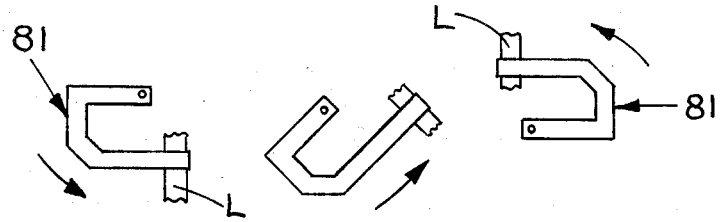
FIGS. 8A, 8B and 8C are schematic, fragmentary, top plane views of the presentator assembly illustrating the sequential movement of the label clamp.

Referring to FIGS. 4, 5 and 8, the presentator assembly 42 includes a clamp arm assembly 81 fixed to a shaft 82 which is mounted for pivotable displacement relative to support bearings fastened to a framework 84. Fixedly secured to the shaft 82 is a pinion 86 which is rotated by a rack gear 88 and fluid cylinder 90. The cylinder 90 is supported by a bracket 92, and upon displacement of the cylinder rod 94 and the rack gear 88 attached thereto, pivots the shaft 82 to reciprocate the clamp assembly 81 approximately 180° between the positions shown by FIGS. 8A and 8C.

The clamp assembly 81 includes generally U-shaped, superposed clamp arms or members 100, 102. The lower member 102 is fixed to the framework 104 attached to the pinion shaft 82, and the upper clamp member 100 is pivotably supported upon the lower clamp member by means of a pivot pin 106. A clamp pad 108 may be provided on the outer end portion of upper clamp member 100. The outer end portions of the clamping members 100, 102 are normally urged towards each other by a spring 110 to grip a label L therebetween. The spring 110 has end portions connected to member 100 and to framework 104. A fluid cylinder 112 is provided for selectively opening the clamping members and releasing the label. The cylinder 112 is mounted on the pivotable framework 104, and the cylinder plunger engages the upper clamping arm 100. Selective actuation of the cylinder 112 overcomes the spring 110 and moves the clamping member 100 relative to the member 102 to release a label held therebetween or to grip the outer end of the label strip extending between the cutter blades, depending upon the positioning of the presentator clamping members.

Figure 14:
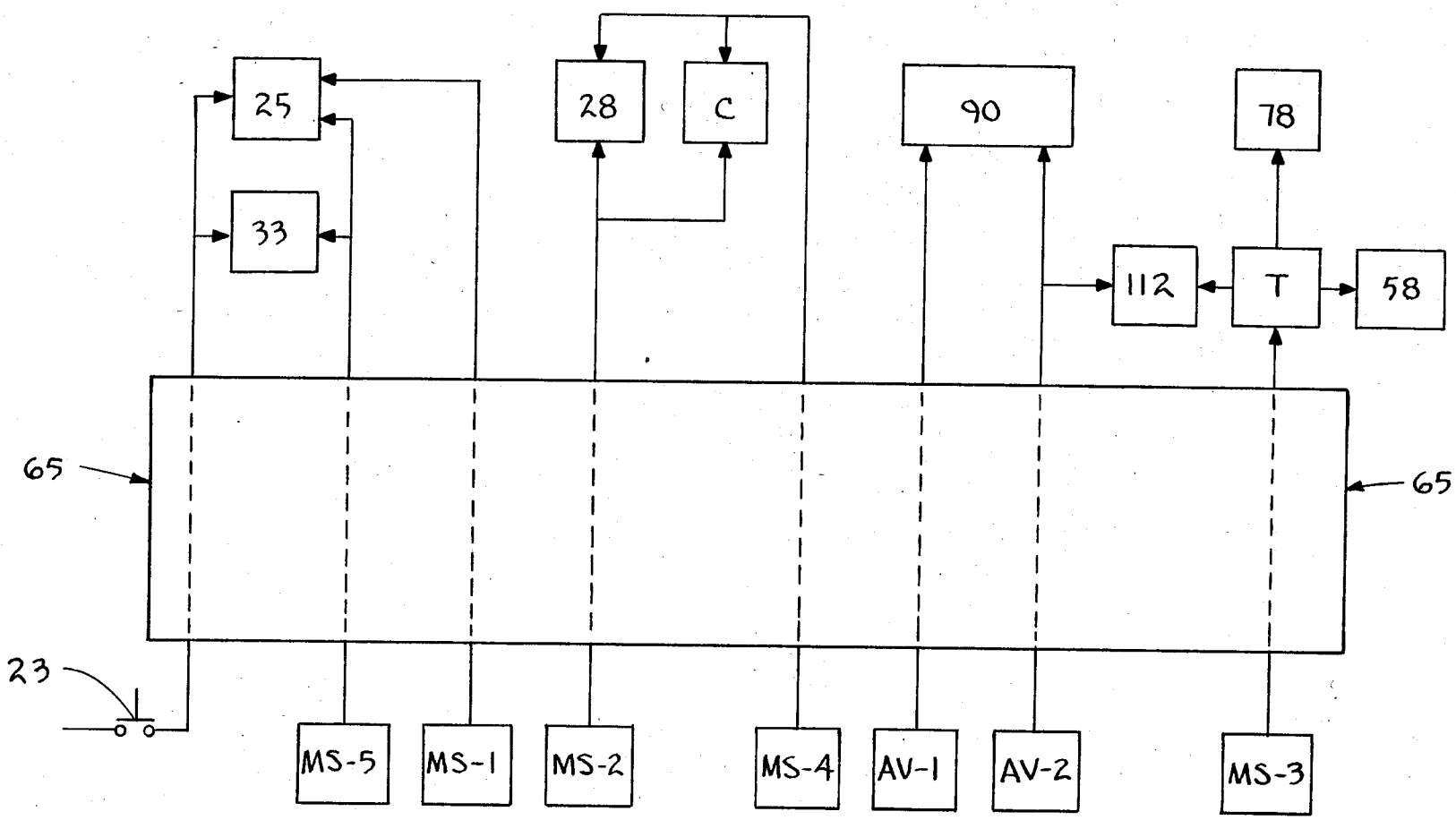
FIG. 14 is a schematic diagram of the various control components for the label feeding and presentating assemblies.

Shown diagrammatically by FIG. 14 are a series of microswitches and air valves which are activated by the carriage 34 upon displacement thereof to control the various machine functions. The valves and microswitches may be positioned on a support member located below the path of travel of the carriage so as to be actuated upon the reciprocable displacement of the carriage. The various valves and switches may be adjustably mounted upon the support member so as to permit the sewing of blanks to form panty hose garments of various sizes and to ensure operation of the various functions in the proper sequences.

In the operation of the device, the supporting arms 30, 32 of the conventional line closer initially are in the collapsed positions ready for receiving blanks B, B, the carriage assembly 34 is in the forwardmost position, FIGS. 1 and 3, and the clamping members 100, 102 of the presentator assembly 42 have a label L gripped therebetween, as shown by FIGS. 1, 3 and 8A. An operator then positions the blanks, B, B on the collapsed arms 30, 32 and positions the blank welt portions in aligned, superposed relation.

The operator actuates switch 23 and through control means 65, the supporting members 30 are displaced in a conventional manner by a fluid cylinder assembly 33 from the collapsed FIG. 12 positions to the expanded FIG. 13 positions. The blanks B, B are expanded by assembly 33 as in the conventional operation of the Savio line closer.

The actuation of switch 23, through control means 65, directs fluid to fluid cylinder 25 to displace the carriage assembly 34, members 30, 32 and blanks B, B rearwardly relative to the stationary sewing head 41 to a prescribed location with the upper portion 41 and needles 130 of the sewing machine are positioned within the upper, opened blank B, while the sewing machine base 45, which may be provided with fabric feed elements, is positioned within the lower blank B, as shown by FIG. 12. After the carriage assembly has been displaced by cylinder 25 to a prescribed location, the carriage contacts a microswitch MS-1 which, through control means 65, directs fluid to the opposite end of cylinder 25 to reverse the direction of movement of the carriage assembly 34. As the carriage now moves forward to the left in FIG. 4, it actuates a second microswitch MS-2 which through control means 65 substantially simultaneously activates the sewing instrumentalities of the sewing machine 28 and the cutter C.

The sewing instrumentalities of the machine 28 are such that upon activation, adjacent blank portions B1 and B3 are sewn together by two generally parallel, closely spaced seams S-1 and S-2, as shown by FIGS. 8 and 12, as the carriage assembly continues to move forward. There is just sufficient space between the seams to receive the blade of the cutter C, FIG. 9. The cutter C is positioned in close proximity to the needles 130 to sever the fabric between the seams as the seams are formed, resulting in a garment as shown by FIG. 10 wherein the seams S-1 and S-2 define the U-shaped seam in the panty portion of the garment. Thus the same are initiated in what will utlimately be the crotch portion of the garment and extend outwardly of the blanks B, B to the end portions which will define the waist band.

Once the carriage assembly 34 has moved forward along the spaced guide rods 35 approximately half the distance of travel and when the seams S-1, S-2 are approximately half completed and approximately midway between the crotch portion and the waist band portion, the carriage assembly 34 contacts an air valve AV-1 which through control 65 controls the rack cylinder 90 to cause the label clamp arm assembly 81 and clamping members 100, 102 to pivot 180° from the FIGS. 3 and 8A position to the FIGS. 4 and 8C position with the clamped label L extending into and positioned within the upper blank B such that the projecting end portion is located in alignment with the sewing needles 130 sewing the seam S-2. The carriage assembly 34 continues to move forward to extend the seam length and the label is sewn to the blanks by the seam, as shown by FIGS. 9 and 10.

Immediately after sewing of the label L to the blanks by seam S-2, the continued movement of the carriage assembly contacts a second air valve AV-2 which, through control 65, activates fluid cylinder 112 to open the clamping members 100, 102 to release the label L and also simultaneously activates fluid cylinder 90, through control means 65, to rotate the clamping members from the FIG. 8C position back to the FIG. 8A position.

Continued forward movement of carriage assembly 34 activates a microswitch MS-3 which, through control means 65, activates the label feed motor 58 and the timer mechanism T to advance the label strip from the spool 43. The length of strip advanced can be adjusted by varying the setting of the timer mechanism T. Actuation of microswitch MS-3, through control 65, also sequentially controls the fluid cylinder 112 to permit the spring 110 to pull clamp arm member 100 towards clamp member 102 with a length of the label strip positioned therebetween, and directs fluid to cylinder 78 and pivot cutter blade 72 to sever the label strip between the clamp members 100, 102 and the feed roll 56.

The carriage assembly 34 continues forward until a microswitch MS-4 is contacted which deactivates the sewing machine 28 and cutter mechanism C substantially simultaneously. The switch MS-4 is positioned such that the sewing instrumentalities 130 will have sewn past the end portions of the blanks forming the garment waist band.

Immediately upon actuation of switch MS-4, another microswitch MS-5 is actuated by the carriage 34 movement. Through the control means 65, this switch controls the cylinder 25 to stop displacement of the carriage assembly 34 and also controls the cylinder arrangement 33 to move the arm members 30, 32 to the FIG. 12 collapsed positions. The garment can then be readily removed from the members 30, 32 by an operator or by mechanical means.

The control means 65 is of a type containing conventional circuitry and components for activating the various motors, cylinder, cutters, etc. in response to activation of the microswitches and air valves.

What is claimed is:

1. A label handling apparatus for use with a line closer machine having sewing instrumentalities for seaming together a pair of individual, tubular hosiery blanks for forming the panty portion of a panty hose garment comprising a supply source of label strip material, means for intermittently feeding a predetermined length of label strip material to a prescribed location, means for clamping the label strip advanced by said feed means to said prescribed location, means for severing said predetermined length of label strip material to define a discrete label, and means for displacing said clamping means and said label in a first direction to position the label internally of one blank of said pair of hosiery blanks and in a second direction to advance said label past the sewing instrumentalities of the line closer machine to sew the label to the hosiery blanks as the pair of blanks is seamed together.

2. A label handling apparatus as recited in claim 1, said severing means including cutting means having saw-toothed cutting edges to define a nonravelling pinking action on the severed end portions of said labels.

3. A label handling apparatus as recited in claim 1, said means for displacing said clamping means including means for conveying said clamped label approximately 180° relative to a hosiery blank to a location within a hosiery blank.

4. A label handling apparatus as recited in claim 3, wherein said clamping means includes a pair of opposed members having label clamping finger portions, means normally biasing said finger portions towards each other, and means for displacing one finger portion away from the other finger portion.

5. A label handling apparatus as recited in claim 4, wherein each of said pair of opposed members has a generally U-shaped configuration, said means for conveying said clamped label 180° including a rack means for rotating said opposed, generally U-shaped members to insert said finger portions and label held thereby internally of a tubular hosiery blank.

6. A label handling apparatus as recited in claim 3, said means for displacing said clamping means further including means for displacing said label longitudinally of one of said hosiery blanks in said second direction past said sewing instrumentalities.

7. In an apparatus for seaming together a pair of tubular hosiery blanks, each blank having welt, leg and foot portions for forming a panty hose garment therefrom, support means for retaining the welt portions of the pair of blanks in expanded, superposed relation, sewing instrumentalities for seaming together welt portions of the expanded pair of blanks, means for displacing said support means with respect to said sewing instrumentalities for positioning the sewing instrumentalities within the confines of at least one of said pair of expanded blanks, and means for conveying a label from a supply source to a position internally of a hosiery blank for alignment with said sewing instrumentalities for sewing said label to said blanks upon displacement of said blanks and label relative to said sewing instrumentalities.

8. Apparatus as recited in claim 7, said sewing instrumentalities sewing said blanks together along two closely spaced, generally parallel seams.

9. Apparatus as recited in claim 8, and further including means for severing the fabric forming the blanks intermediate said generally parallel seams.

10. Apparatus as recited in claim 7, said means for conveying a label including clamp means for gripping a label at a location remote to said hosiery blanks and said sewing instrumentalities, and means for displacing said clamped label in a prescribed path to a selected position within one of said expanded blanks.

11. Apparatus as recited in claim 10, said conveyor means further including means for rotating the clamped label approximately 180° and for releasing said label immediately upon being sewn by said sewing instrumentalities.

12. Apparatus as recited in claim 10, wherein said conveying means includes opposed clamp members having a generally U-shaped configuration.

13. Apparatus as recited in claim 7, said means for conveying a label further including means for selectively feeding a prescribed length of label strip, means for clamping the strip, and means for severing the strip intermediate said clamping means and said feeding means.

14. Apparatus as recited in claim 13, wherein said feeding means includes a driven roll and spring means for biasing said label strip into engagement with said driven roll.

15. In an apparatus for conveying a label from a first location to a second location within the confines of tubular fabirc article, support means, a clamp arm assembly pivotably mounted upon said support means, means for selectively rotating said clamp arm assembly relative to said support means, said clamp arm assembly including superposed clamp members having a generally U-shaped configuration for selectively gripping a label therebetween, means for selectively urging said clamp members towards or away from each other, said means for selectively rotating said clamp arm assembly including means for displacing a label gripped by said clamp member from said first location located outwardly of said tubular fabric article to said second location with the label positioned within the confines of the tubular fabric article.

16. The method of sewing a label to a panty hose garment during the formation of the U-shaped seam sewing together two expanded tubular hosiery blanks to form the garment panty portion comprising the steps of: displacing superposed, expanded hosiery blanks in a first direction relative to sewing instrumentalities to a position with the instrumentalities positioned within the blanks, sewing adjacent portions of the fabric blanks together to define spaced, generally parallel seams as the blanks are displaced relative to the sewing instrumentalities, cutting the fabric between the spaced, generally parallel means, selectively displacing a label from a first location remote to the hosiery blanks to a second location within the confines of one of the hosiery blanks during the formation of the parallel seams, and attaching the label to the blanks during formation of the seams.

* * * * *